US010118423B2

(12) United States Patent
Nakata et al.

(10) Patent No.: US 10,118,423 B2
(45) Date of Patent: Nov. 6, 2018

(54) RECORDING DEVICE

(71) Applicant: SEIKO EPSON CORPORATION, Tokyo (JP)

(72) Inventors: Satoshi Nakata, Matsumoto (JP); Hitoshi Igarashi, Shiojiri (JP); Kazuo Otsuka, Azumino (JP); Masafumi Furuyama, Cikarang Selatan (ID)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/497,765

(22) Filed: Apr. 26, 2017

(65) Prior Publication Data

US 2017/0313107 A1 Nov. 2, 2017

(30) Foreign Application Priority Data

May 2, 2016 (JP) ..... 2016-092313

(51) Int. Cl.
*B41J 2/01* (2006.01)
*B41J 25/00* (2006.01)

(52) U.S. Cl.
CPC ..... *B41J 25/006* (2013.01)

(58) Field of Classification Search
USPC ..... 347/5, 9, 101
See application file for complete search history.

(56) References Cited

U.S. PATENT DOCUMENTS 9,205,662 B2 * 12/2015 Tsukida ..... B41J 2/17566
2005/0285886 A1 * 12/2005 Okamoto ..... B41J 2/17509 347/7
2006/0103707 A1 * 5/2006 Askeland ..... B41J 3/543 347/101
2014/0060692 A1 3/2014 Nakamura et al.

FOREIGN PATENT DOCUMENTS

JP 2013-244658 12/2013
JP 2014-040080 3/2014

* cited by examiner

*Primary Examiner* — Lam Nguyen
(74) *Attorney, Agent, or Firm* — Workman Nydegger

(57) ABSTRACT

A recording device includes a carriage that has a recording head that performs recording on a medium and a plurality of liquid cartridges that house a liquid to be ejected from the recording head, the plurality of liquid cartridges being arranged in a line in a direction that intersects the movement direction of the carriage and being provided with target detection units, and a detector that includes a moving part which moves in a direction that intersects the movement direction of the carriage and that, by the movement of the moving part, detects the residual amount of the liquid between the detector and each of the target detection units of the plurality of the liquid cartridges.

8 Claims, 13 Drawing Sheets

RECORDING DEVICE

BACKGROUND

1. Technical Field

The present invention relates to a recording device that performs recording on a medium.

2. Related Art

An ink jet printer, which is an example of a recording device, is a so-called serial-type recording device that is formed so as to perform recording by discharging a liquid (an example of which is ink) onto a medium from a recording head while a carriage on which the recording head is mounted reciprocates in a main scanning direction.

Moreover, a plurality of ink cartridges may be installed in the carriage including the recording head in the serial-type recording device.

Moreover, as a method of detecting the residual amount of ink in an ink cartridge, a method in which light is radiated from an external unit toward a prism that is capable of contacting the ink in the ink cartridge and is received at an optical sensor is well known (JP-A-2014-40080).

Regarding JP-A-2014-40080, although there is no detailed description, in the structure of JP-A-2014-40080, a plurality of ink cartridges are arranged in a line along the movement direction of the carriage and, in this structure, detection is performed by positioning, using the movement of the carriage, a prism of each of the ink cartridges at a position opposite a single optical sensor. However, such a detection method cannot be applied if the arrangement direction of the ink cartridges is changed, and, as a result, an optical sensor has to be provided at a position opposite a corresponding prism of each of the ink cartridges. This means a plurality of optical sensors have to be provided and consequently there will be an increase in cost.

SUMMARY

An advantage of some aspects of the invention is that even in the case where the arrangement direction of ink cartridges is not a direction along the movement direction of a carriage, detection of the residual amount of ink in each of the ink cartridges may be performed without incurring an increase in cost.

A recording device according to an aspect of the invention includes a carriage that has a recording head that performs recording on a medium and a plurality of liquid cartridges that house a liquid to be ejected from the recording head, the plurality of liquid cartridges being arranged in a line in a direction that intersects a movement direction of the carriage and being provided with a target detection unit, a detector that includes a moving part which moves in a direction that intersects the movement direction of the carriage and that, by the movement of the moving part, detects the residual amount of the liquid between the detector and each of the target detection units of the plurality of the liquid cartridges.

According to the aspect, in the carriage, the plurality of the liquid cartridges are provided in a line in a device depth direction that is a direction that intersects a device width direction that is the movement direction of the carriage. The detector that detects the residual amount of liquid includes the moving part, which moves along a direction that intersects the movement direction of the carriage, that is, the direction in which the plurality of the liquid cartridges are arranged, and, by the movement of the moving part, detects the residual amount of the liquid between the detector and each of the target detection units of the plurality of the liquid cartridges. Therefore, even in a structure in which the ink cartridges are not arranged in a direction that intersects the movement direction of the carriage, it is possible to detect the residual amount of the liquid between the detector and each of the target detection units of the plurality of the liquid cartridges while suppressing an increase in cost.

According to the aspect, a feeding roller that feeds the medium in a direction that intersects the movement direction of the carriage and a motion converter that moves the moving part by converting rotation of the feeding roller into linear movement in a direction that intersects the movement direction of the carriage may further be provided.

According to the aspect, because a feeding roller that feeds the medium in a direction that intersects the movement direction of the carriage and a motion converter that moves the moving part by converting rotation of the feeding roller into linear movement in a direction that intersects the movement direction of the carriage may further be provided, it is not necessary to provide a drive source for the sole purpose of moving the moving part and an increase in cost can be suppressed.

According to the aspect, the feeding roller may include a first feeding roller that is provided upstream of the recording head in a medium transport direction and a second feeding roller that is provided downstream of the recording head in the medium transport direction. The motion converter may include a first pulley that is provided on a rotation shaft of the first feeding roller, a second pulley that is provided on a rotation shaft of the second feeding roller, and a belt that is looped around the first pulley and the second pulley and that engages with the moving part.

According to the aspect, it is possible to simplify the structure of the motion converter and reduce the cost thereof.

According to the aspect, the motion converter may include a rotation body that receives rotational motive power from the feeding roller and a linear motion member that includes a boss that is loosely inserted in a groove formed in the rotation body, the linear motion member moving in a direction which intersects the movement direction of the carriage as a result of the boss being pushed in the direction which intersects the movement direction of the carriage by the rotation of the rotation body and the linear motion member engaging with the moving part.

According to the aspect, it is possible to simplify the structure of the motion converter and reduce the cost thereof.

According to the aspect, a wiping unit that includes a wiper that wipes the recording head while moving in a direction that intersects the movement direction of the carriage may further be included and the moving part may be provided in the wiping unit.

According to the aspect, because the moving part is provided in the wiping unit, it is not necessary to provide a drive source for the sole purpose of driving the moving part and it is therefore possible to suppress an increase in the cost of the device.

According to the aspect, a cam surface, which is formed so as to be a surface inclined with respect to the movement direction of the carriage, may be provided on the carriage, the moving part is capable of engaging with the cam surface and may be provided in a cam follower unit that is capable of moving in a direction that intersects the movement direction of the carriage, and the cam follower unit moves in the direction that intersects the movement direction of the carriage as a result of the cam follower unit being pushed by the cam surface that moves with the movement of the carriage.

According to the aspect, because the cam follower unit is capable of moving in a direction that intersects the movement direction of the carriage by the cam surface pushing the cam follower unit with the movement of the carriage, it is not necessary to provide a drive source for the sole purpose of moving the moving part and an increase in the cost of the device can be suppressed.

According to the aspect, the moving part may be provided on an arm that is capable of swinging about a fulcrum and moves as the arm swings.

According to the aspect, it is possible to simplify the structure that moves the moving part and reduce the cost thereof.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In addition, the same reference signs will be used to refer to similar structures in the embodiments, and these structures will only be described in the first embodiment and description thereof will be omitted in subsequent embodiments.

Figure 1:
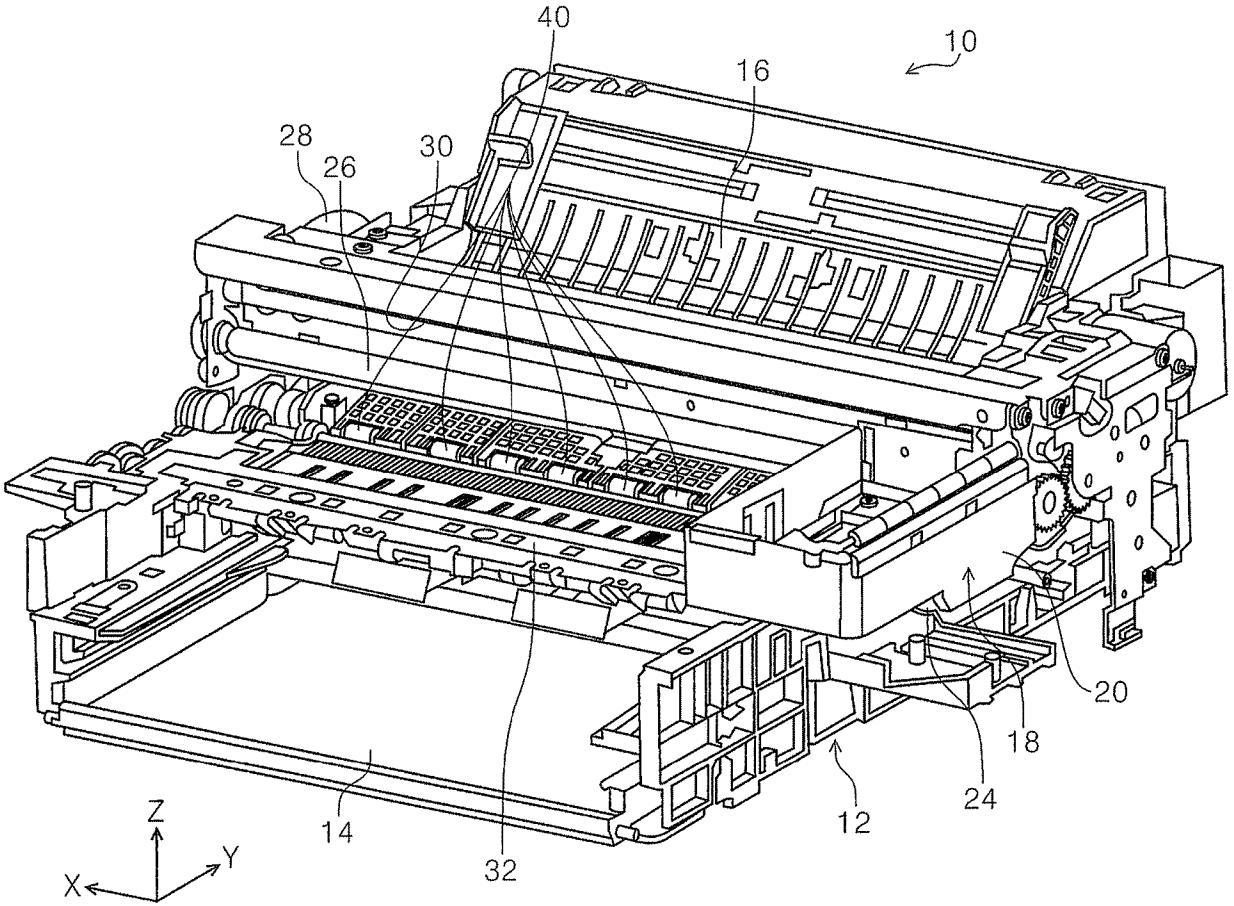
FIG. 1 is an external perspective view of the main body of a printer.
Figure 2:
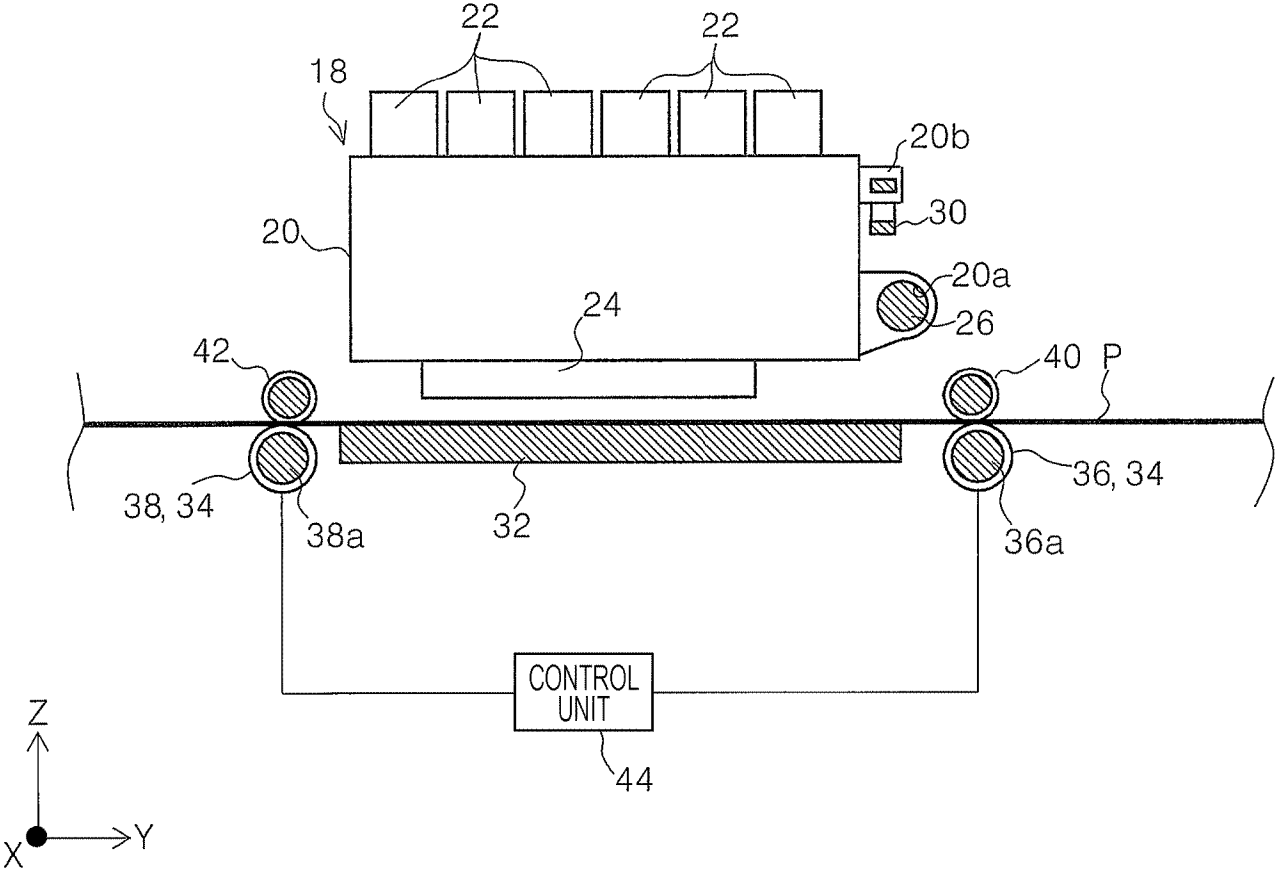
FIG. 2 is a side view illustrating the area around a carriage in a paper transport path.
Figure 3:
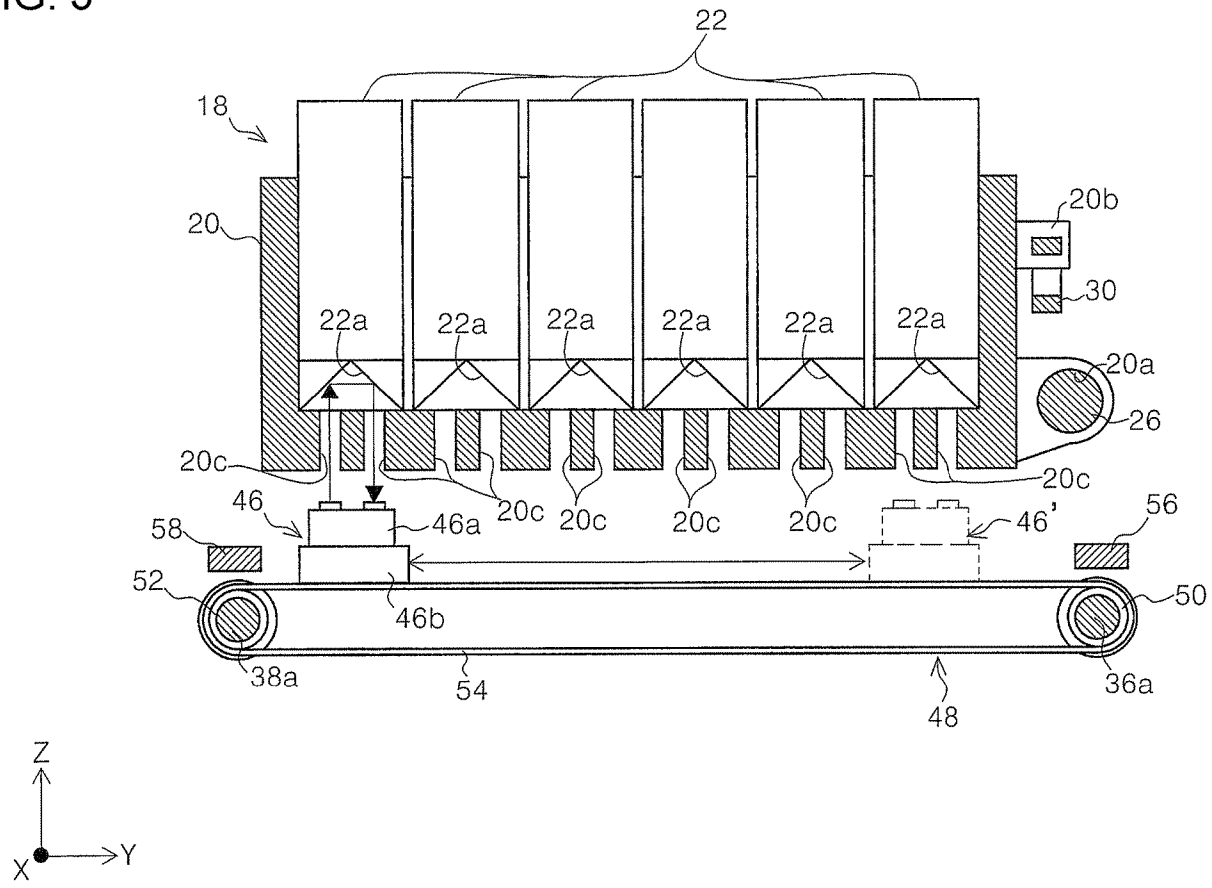
FIG. 3 is a cross-sectional diagram illustrating a detector according to a first embodiment.
Figure 4:
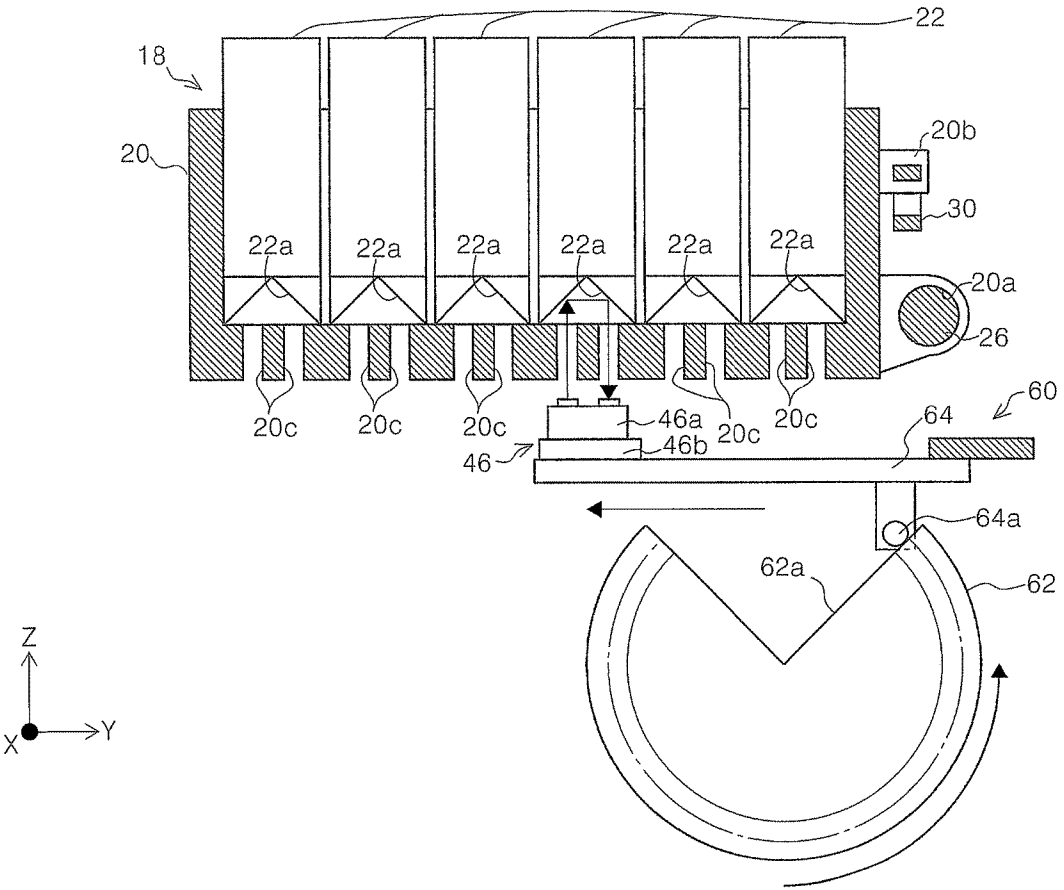
FIG. 4 is a cross-sectional diagram illustrating a detector according to a second embodiment in a first state.
Figure 5:
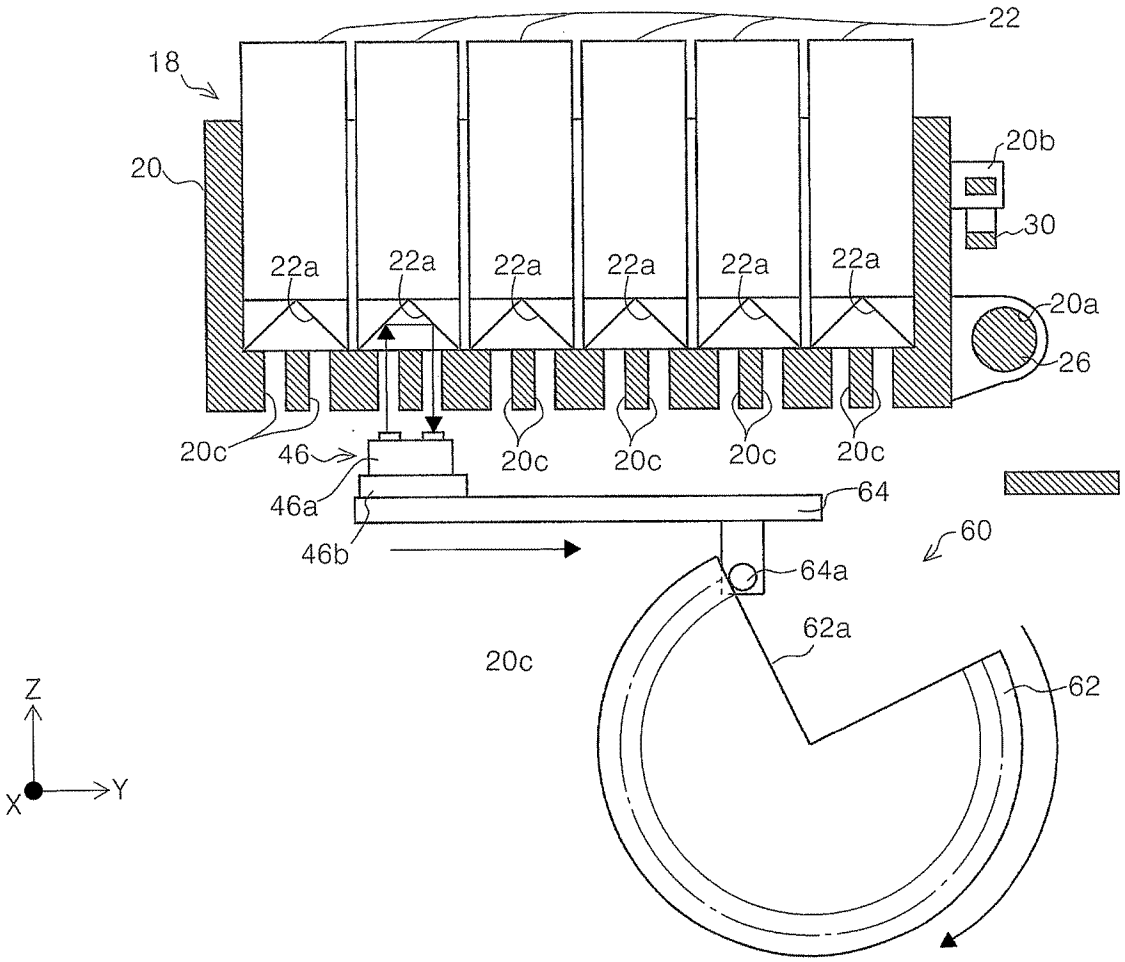
FIG. 5 is a cross-sectional diagram illustrating the detector according to the second embodiment in a second state.
Figure 6:
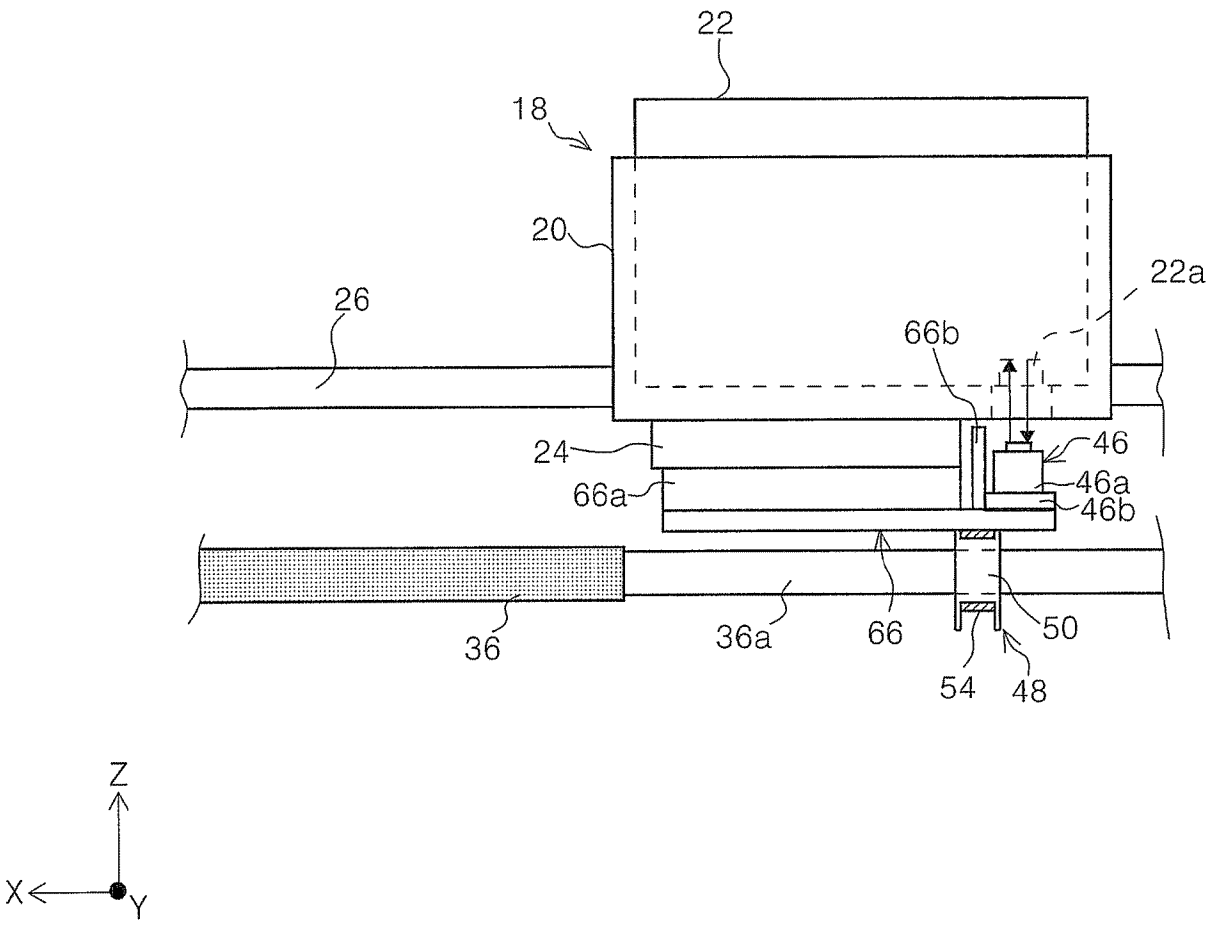
FIG. 6 is a front view of a detector according to a third embodiment.

FIG. 1 is an external perspective view of the main body of a printer, FIG. 2 is a side view illustrating the area around a carriage in a paper transport path, FIG. 3 is a cross-sectional diagram illustrating a detector according to a first embodiment, FIG. 4 is a cross-sectional diagram illustrating a detector according to a second embodiment, FIG. 4 is a cross-sectional diagram illustrating the detector according to the second embodiment in a first state, FIG. 5 is a cross-sectional diagram illustrating the detector according to the second embodiment in a second state, and FIG. 6 is a front view of a detector according to a third embodiment.

Figure 7:
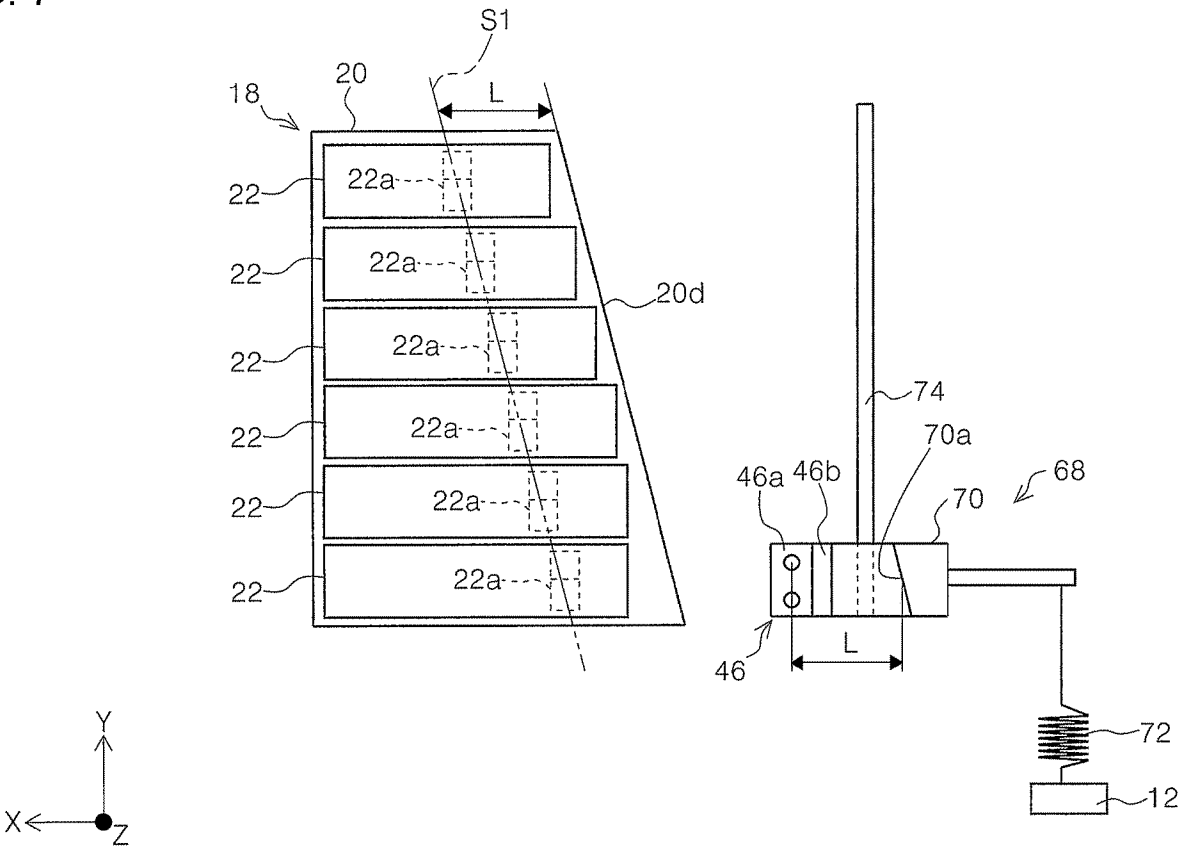
FIG. 7 is a plan view illustrating a detector according to a fourth embodiment in a first state.
Figure 8:
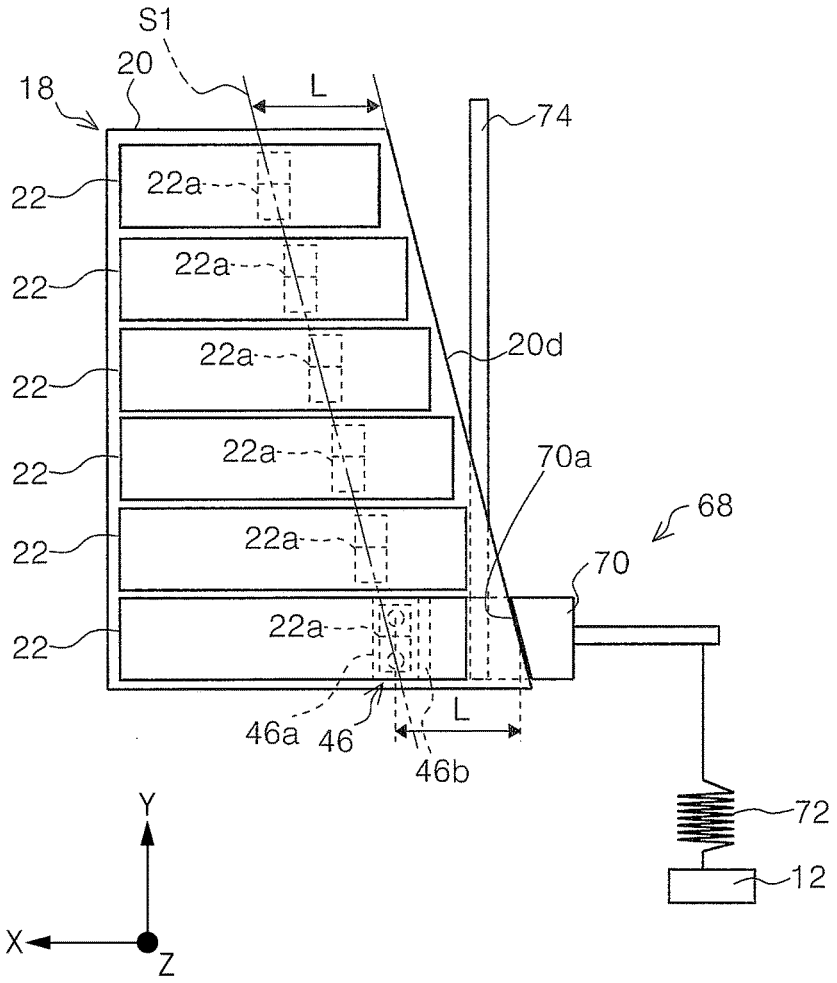
FIG. 8 is a plan view illustrating the detector according to the fourth embodiment in a second state.
Figure 9:
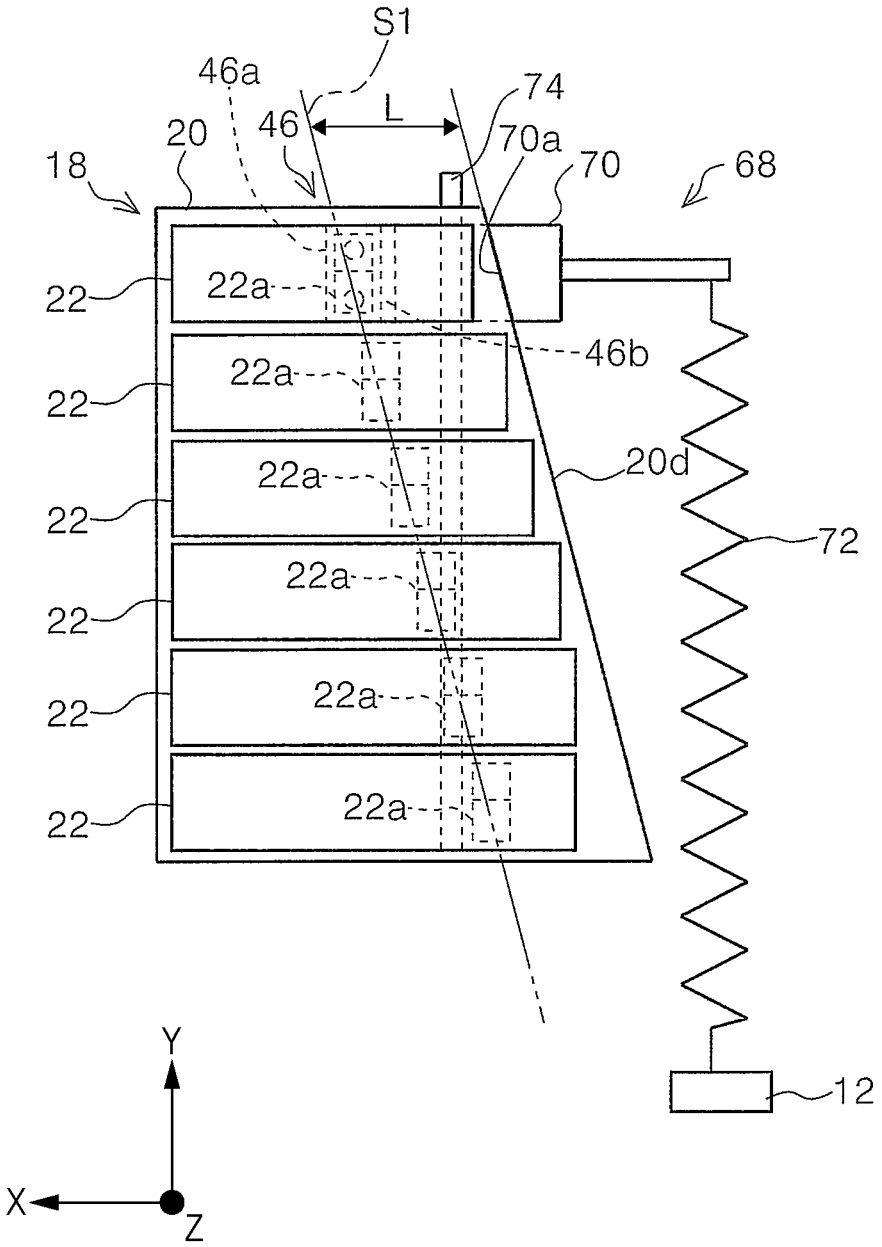
FIG. 9 is a plan view illustrating the detector according to the fourth embodiment in a third state.
Figure 10:
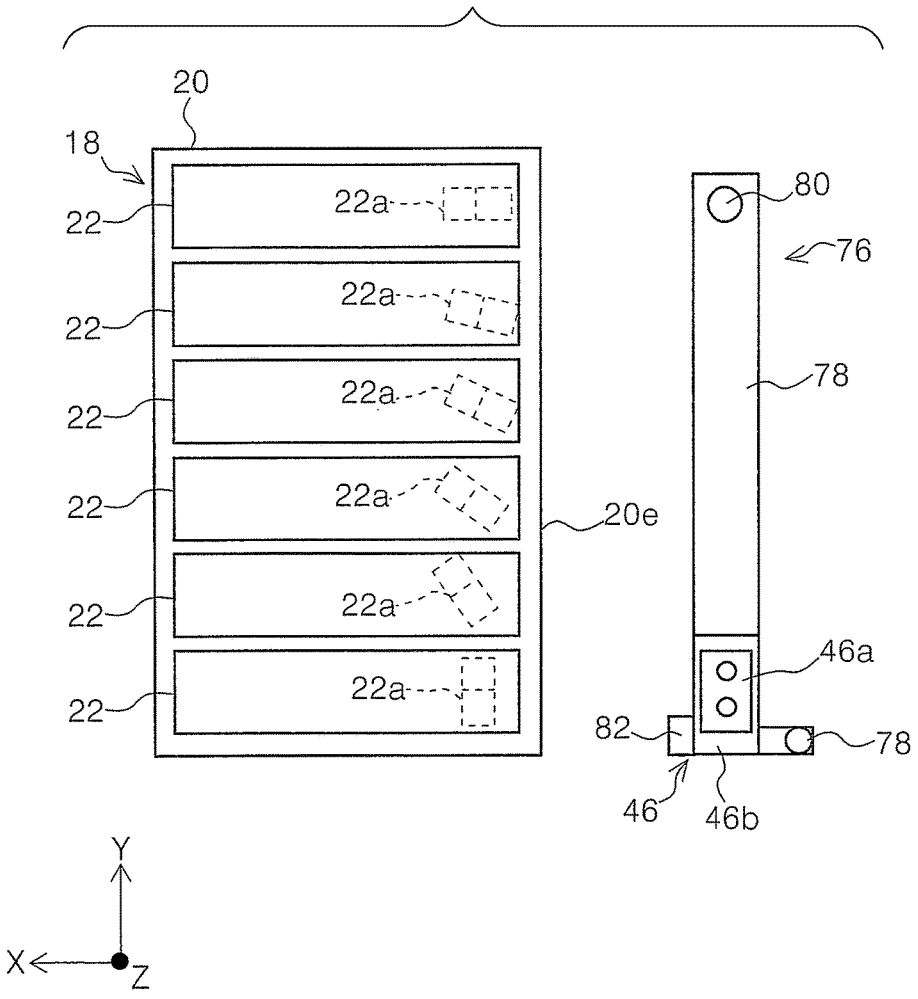
FIG. 10 is a plan view illustrating a detector according to a fifth embodiment in a first state.
Figure 11:
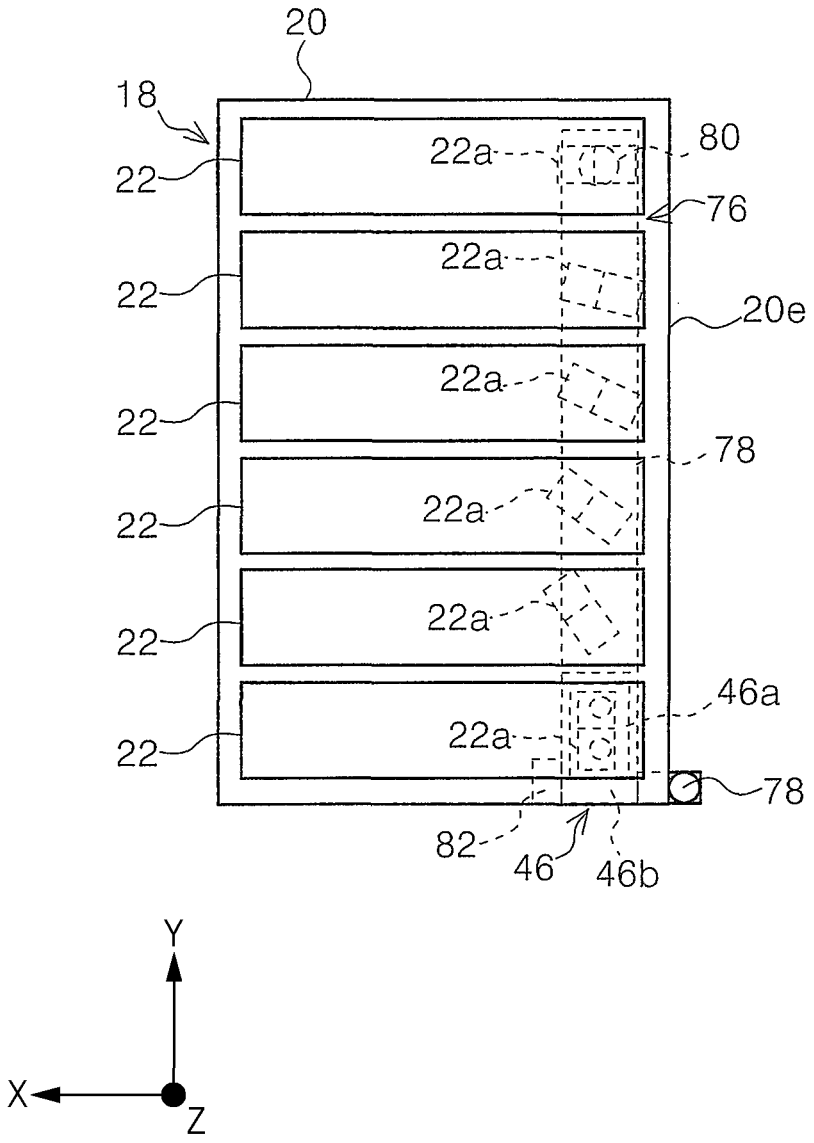
FIG. 11 is a plan view illustrating the detector according to the fifth embodiment in a second state.
Figure 12:
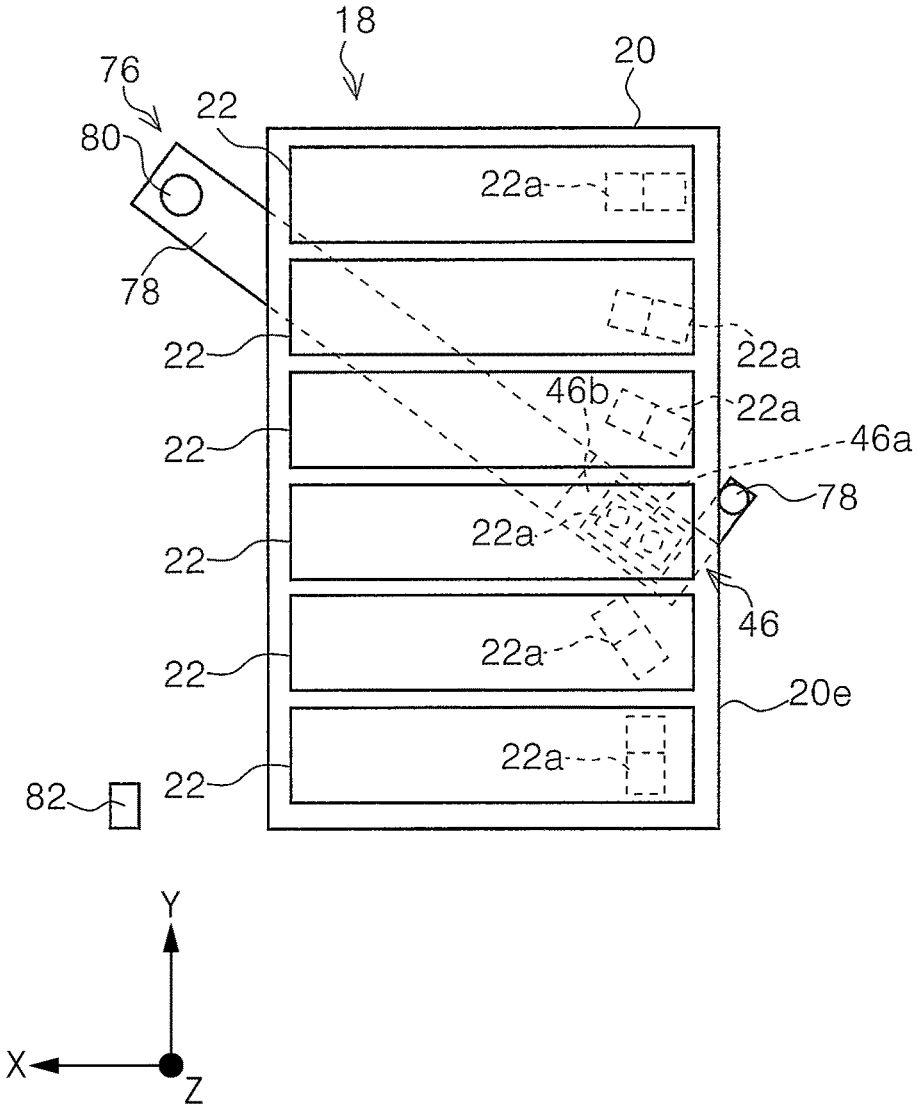
FIG. 12 is a plan view illustrating the detector according to the fifth embodiment in a third state.
Figure 13:
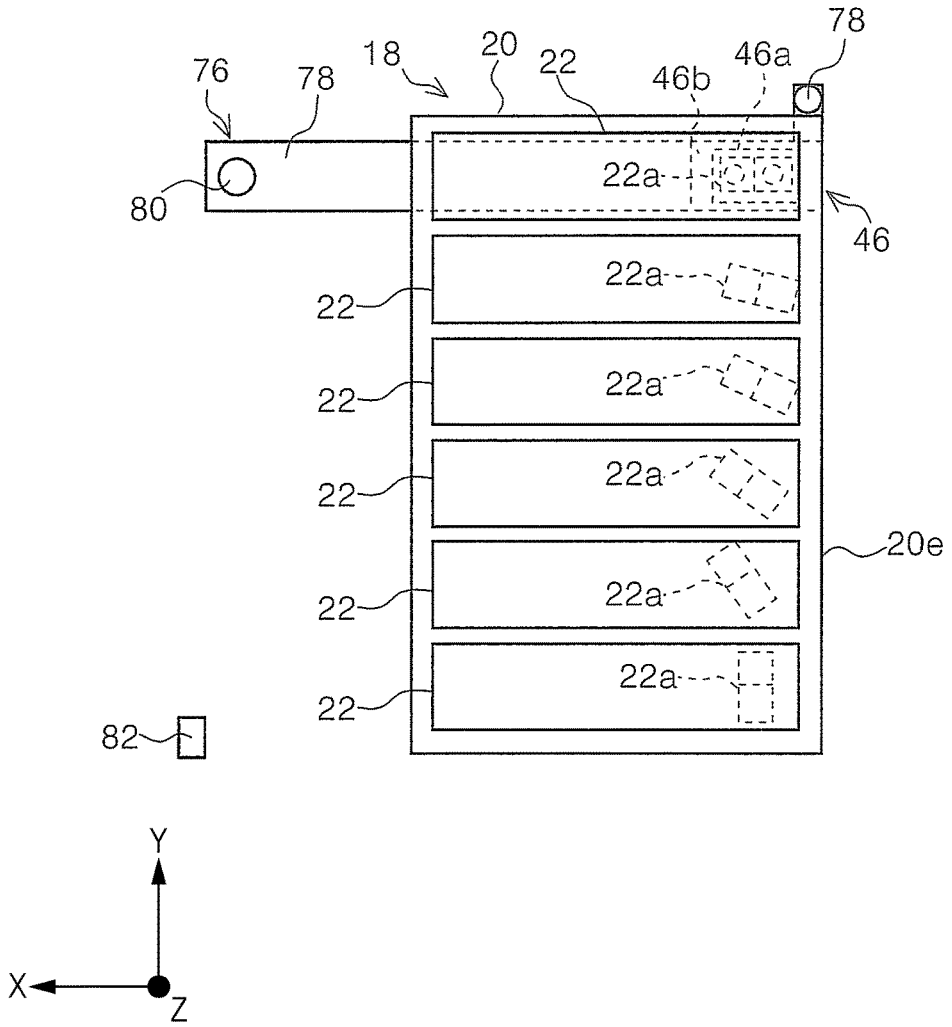
FIG. 13 is a plan view illustrating the detector according to the fifth embodiment in a fourth state.

FIG. 7 is a plan view illustrating a detector according to a fourth embodiment in a first state, FIG. 8 is a plan view illustrating the detector according to the fourth embodiment in a second state, FIG. 9 is a plan view illustrating the detector according to the fourth embodiment in a third state, FIG. 10 is a plan view illustrating a detector according to a fifth embodiment in a first state, FIG. 11 is a plan view illustrating the detector according to the fifth embodiment in a second state, FIG. 12 is a plan view illustrating the detector according to the fifth embodiment in a third state, and FIG. 13 is a plan view illustrating the detector according to the fifth embodiment in a fourth state.

Moreover, in the X-Y-Z coordinate system illustrated in each diagram, the X direction corresponds to a main scanning direction of a carriage (movement direction), that is, a width direction of a recording device, the Y direction corresponds to a medium transport direction, that is, a depth direction of the recording device, and the Z direction corresponds to a device height direction. In addition, in each diagram, the positive-X-direction side corresponds to the left side of the device, the negative-X-direction side corresponds to the right side of the device, the negative-Y-direction side corresponds to the front surface side of the device, the positive-Y-direction side corresponds to the rear surface side of the device, the positive-Z-direction side corresponds to the upper side of the device, and the negative-Z-direction side corresponds to the lower side of the device.

Summary of Printer

Referring to FIG. 1, a printer 10 includes a device main body 12 that is inside an outer packaging member (not illustrated). A medium housing unit 14 that houses a medium is provided in a lower portion of the device main body 12. The medium housing unit 14 is installed so as to be removable from the front surface side of the device main body 12.

Moreover, a rear-surface-side medium feeding path 16 along which the medium is inserted and fed from the upper side of the device main body 12 is provided on the rear surface side of the device main body 12.

Moreover, a carriage 18 is provided on the front surface side of the device main body 12 so as to be capable of reciprocating in the device width direction of the device main body 12. As illustrated in FIG. 1, the position of the carriage 18 located at a right-side end portion of the device main body 12 in the device width direction is the home position of the carriage 18 of the invention. In addition, for example, the home position of the carriage 18 may be set on the left-side end portion of the device rather than on the right-side end portion.

Further, the carriage 18 will be described with reference to FIG. 2. The carriage 18 includes a housing 20 that is box-shaped with an opening on the upper side in the device height direction. In the housing 20, a plurality of ink cartridges 22 serving as "liquid cartridges" are installed so as to be removable. The ink cartridges 22 are formed so as to be capable of housing ink serving as "a liquid". In the ink cartridges 22, inks of various colors, for example, black, magenta, yellow, and cyan are respectively housed.

The plurality of ink cartridges 22 are installed in the housing 20 of the carriage 18 in a direction that intersects the device width direction, which is the movement direction of the carriage 18, more specifically, the plurality of ink cartridges 22 are installed in a line that extends in the device depth direction.

A recording head 24 is provided in the lower portion of the housing 20 of the carriage 18. A plurality of nozzle holes (not illustrated) are provided in the lower surface of the recording head 24. Ink is supplied from the ink cartridges 22 installed in the housing 20 to the recording head 24 and is discharged downward from the nozzle holes.

Moreover, a bearing 20*a* is provided on the rear surface side of the housing 20. A guide shaft 26 is inserted in the bearing 20*a*. The guide shaft 26 extends along the rear surface side of the carriage 18 of the device main body 12 in the device width direction. The guide shaft 26 guides the carriage 18 when the carriage 18 moves in the device width direction.

Here, the movement of the carriage 18 in the device width direction will be described. A drive motor 28 is arranged on the left-side end portion of the device main body 12 in the device width direction (the positive-X-direction-side end portion in FIG. 1). A drive pulley (not illustrated) is installed in the drive motor 28. A driven pulley (not illustrated) is installed on the right-side end portion of the device main body 12 in the device width direction (the negative-X-direction-side end portion in FIG. 1) so as to be capable of rotation. A drive belt 30 is wound around the drive pulley and the driven pulley.

A belt holding portion 20*b* is provided on the rear surface side of the housing 20 and the belt holding portion 20*b* holds at least one portion of the drive belt 30. Thus, when the drive motor 28 operates, the drive pulley is driven so as to rotate and, consequently, the drive belt 30 is made to rotate in the direction of rotation of the drive pulley. Consequently, the carriage 18 is made to move in the device width direction. In addition, a carriage detector (not illustrated) that detects the position of the carriage 18 in the device width direction, for example, a carriage detector formed of a linear scale and encoder sensor, is included in the device main body 12. A control unit 44 (described later) controls movement of the carriage 18 in the device width direction on the basis of detection information obtained by the carriage detector.

Moreover, a medium supporting member 32 that extends in the device width direction is provided below the carriage 18 in the device height direction. At least one portion of the movement region of the carriage 18 in the device width direction is arranged so as to be capable of being opposite the recording head 24.

As illustrated in FIG. 2, a plurality of feeding rollers 34 that feed the medium in a medium transport direction are provided in the device main body 12. The feeding rollers 34 include a first feeding roller 36 that is provided upstream of the recording head 24 in the medium transport direction and a second feeding roller 38 that is provided downstream of the recording head 24. The first feeding roller 36 and the second feeding roller 38 are each driven by a drive source (not illustrated) so as to rotate. In addition, the bold solid line indicated by the sign P in FIG. 2 illustrates the transport path along which the medium is transported in the printer 10.

The first feeding roller 36 abuts against driven rollers 40. The driven rollers 40 are formed so as to be capable of being driven by the first feeding roller 36 so as to rotate and are urged toward the first feeding roller 36 by an urger (not illustrated). The first feeding roller 36 and the driven rollers 40 are capable of nipping the medium and transporting the medium downstream in the medium transport direction.

Similarly, the second feeding roller 38 abuts against driven rollers 42. The driven rollers 42 are formed so as to be capable of being driven by the second feeding roller 38 so as to rotate and are urged toward the second feeding roller 38 by an urger (not illustrated). The second feeding roller 38 and the driven rollers 42 are capable of nipping the medium and transporting the medium downstream in the medium transport direction.

Here, the transport path of a medium in the printer 10 will be described. When a medium that is housed in the medium housing unit 14 is fed out downstream in the medium transport direction from the medium housing unit 14 by a supplier (not illustrated), it is fed up to the position of the first feeding roller 36 in the medium transport path. Thereafter, the medium is nipped by the first feeding roller 36 and the driven rollers 40 and then fed to a region opposite the recording head 24.

The medium that has been fed to the region opposite the recording head 24 is supported on its rear surface by the medium supporting member 32. Thereafter, recording is performed by ink being discharged from the nozzle holes of the recording head 24 toward the recording surface (front surface) of the medium that is opposite the recording head 24. After recording has been performed, the medium is nipped by the second feeding roller 38 and the driven roller 42 and is discharged toward the device front surface side of the printer 10.

Also, a medium that has been fed into the device main body 12 along the rear-surface-side medium feeding path 16 is fed into the region opposite the recording head 24 by the first feeding roller 36 and the driven rollers 40 and, after recording has been performed by the recording head 24, is discharged toward the front surface side of the device by the second feeding roller 38 and the driven roller 42.

In addition, in this embodiment, the control unit 44 that is formed as an electric circuit that includes a plurality of electrical components is provided in the device main body 12. The control unit 44 controls the drive motor 28, and the drive source that drives the first feeding roller 36 and the second feeding roller 38 so as to rotate. Moreover, the control unit 44 controls the movement of the carriage 18 and a recording operation of the recording head 24.

Hereinafter, the first to fifth embodiments will be described in order. In addition, the basic concept of the invention involves causing a detector 46 (to be described later) to move in the device depth direction with respect to the carriage 18 in which a plurality of ink cartridges are installed in a line in the device depth direction, which is the medium transport direction, and to sequentially detect target detection units 22*a* (to be described later) that are respectively provided on a lower surface of the ink cartridges 22.

First Embodiment

Detector and Motion Converter

The detector 46 and a motion converter 48 of a first embodiment will be described with reference to FIG. 3. The detector 46 is, for example, formed as an optical sensor that radiates light toward an object from a light-emitting unit and detects the intensity of reflected light received by a light-receiving unit that receives light reflected from the object. The detector 46 includes a sensor body 46*a* and a moving part 4*b*.

The motion converter 48 includes a first pulley 50, a second pulley 52, and a belt 54. The first pulley 50 is installed on a rotation shaft 36*a* of the first feeding roller 36 so as to be capable of rotating together with the rotation shaft 36*a*. The second pulley 52 is installed on a rotation shaft 38*a* of the second feeding roller 38 so as to be capable of rotating together with the rotation shaft 38*a*. The belt 54 is wound around the first pulley 50 and the second pulley 52. The moving part 46*b* of the detector 46 is installed on a device-height-direction upper-side portion of the belt that has been wound around the first pulley 50 and the second pulley 52.

When the first feeding roller 36 and the second feeding roller 38 are rotated in a clockwise direction in FIG. 3, the first pulley 50 and the second pulley 52 also rotate in a clockwise direction in FIG. 3. Consequently, the belt 54 also rotates in a clockwise direction in FIG. 3 and the detector 46 moves from the device front surface side toward the device rear surface side in the device depth direction. In addition, reference numeral 46' in FIG. 3 indicates a detector that has moved from the device front surface side to the device rear surface side.

On the other hand, when the first feeding roller 36 and the second feeding roller 38 are rotated in an anti-clockwise direction in FIG. 3, the first pulley 50 and the second pulley 52 also rotate in an anti-clockwise direction in FIG. 3 and the belt 54 also rotates in an anti-clockwise direction in FIG. 3. As a result, the detector 46 moves from the device rear surface side to the device front surface side in the device depth direction. Therefore, the motion converter 48 is capable of converting rotation of the feeding rollers 34 into linear movement in the device depth direction.

The motion converter 48 includes a first limiting unit 56 and a second limiting unit 58. The first limiting unit 56 and the second limiting unit 58 are provided in order to limit the movement region of the detector 46 in the device depth direction. Specifically, the first limiting unit 56 is provided at a position that corresponds to the first pulley 50 in the device depth direction. After the detector 46 has moved to the first pulley 50 side, the first limiting unit 56 comes into contact with the moving part 46*b* of the detector 46 and stops movement of the detector 46 toward the device rear surface side. In addition, in this state, in the case where the rotation of the first feeding roller 36 and the second feeding roller 38 continues (rotation in the clockwise direction in FIG. 3), the first pulley 50 and the second pulley 52 are formed so as to be capable of running idle with respect to the belt 54.

The second limiting unit 58 is provided at a position that corresponds to the second pulley 52 in the device depth direction. After the detector 46 has moved to the second pulley 52 side, the second limiting unit 58 comes into contact with the moving part 46*b* of the detector 46 and stops movement of the detector 46 toward the device front surface side. In addition, in this state, in the case where the rotation of the first feeding roller 36 and the second feeding roller 38 continues (rotation in the anti-clockwise direction in FIG. 3), the first pulley 50 and the second pulley 52 are formed so as to be capable of running idle with respect to the belt 54.

Moreover, the target detection units 22*a* are provided in a lower portion of the ink cartridges 22. In the target detection units 22*a*, as an example, prisms are respectively provided, and are formed so as to receive light from below the ink cartridges 22 and reflect the light that has been received on the bottom side of the ink cartridges 22.

Moreover, a plurality of openings 20*c* are provided on the lower surface of the housing 20 of the carriage 18. The openings 20*c* are provided at positions that correspond to the target detection units 22*a* of the ink cartridges 22 installed in the housing 20 in the device depth direction. As an example, a pair of the openings 20*c* are provided in the housing 20 for each of the ink cartridges 22.

As illustrated in FIG. 3, light that has been emitted from the light-emitting unit of the detector 46 (refer to the upward arrow from the detector 46 in FIG. 3) enters the target detection units 22*a* of the lower portion of the ink cartridges 22 via one of the pair of the openings 20*c*. Thereafter, the light that has entered the target detection units 22*a* is reflected downward in the device height direction by the prism. The reflected light (refer to the downward arrow from the target detection units 22*a* in FIG. 3) enters the light-receiving unit of the detector 46 via the other one of the pair of the openings 20*c*. Thereafter, the detector 46 transmits detection information of the detection strength of the reflected light or the like to the control unit 44. The control unit 44 estimates the residual amount of ink in the ink cartridges 22 on the basis of the detection information.

In addition, regarding the position control of the detector 46 in the device depth direction, for example, a rotation amount detector that detects the amount of rotation of an encoder sensor or the like is provided in the rotation shaft 36*a* of the first feeding roller 36 or the rotation shaft 38*a* of the second feeding roller 38 and is capable of performing control by detecting the rotation amount of the rotation shafts 36*a* and 38*a*.

Moreover, even though the detector 46 and the motion converter 48 are, for example, formed so as to be arranged in the vicinity of the home position of the carriage 18 in the device width direction of the device main body 12, they are not limited to this configuration and may be suitably arranged in the device width direction.

The detector 46, through the motion converter 48, is capable of performing detection of the residual amount of ink in each of the ink cartridges 22 by being made to sequentially move below the plurality of the ink cartridges 22 installed in the housing 20. Therefore, in the case where the plurality of the ink cartridges 22 are arranged side by side in the device depth direction, because detection of the residual amount is performed by a single detector 46, it is possible to suppress an increase in the cost of the printer 10. Moreover, because it is possible to perform detection of the residual amount of ink of each of the ink cartridges 22 without moving the carriage 18, it is possible to decrease movement of the carriage 18 that is not expected by the user and to decrease any anxiety the user may have regarding such unexpected movement.

Modification Example of First Embodiment (1) Even though the motion converter 48 of this embodiment is formed so as to convert rotational force into linear motion in the device depth direction by transferring rotation of the first feeding roller 36 and the second feeding roller 38 to the belt 54, instead of this configuration, a gear may be provided to at least one of the rotation shaft 36*a* and the rotation shaft 38*a* and a rack and pinion mechanism that includes a rack that engages with the gear may be formed, or a ball screw may be provided and a mechanism that converts rotational movement of the rotation shaft 36*a* and the rotation shaft 38*a* into linear motion may be formed.

(2) In this embodiment, in the case where the moving part 46*b* of the detector 46 comes into contact with the first limiting unit 56 or the second limiting unit 58, if the rotation of the first feeding roller 36 and the second feeding roller 38 continues, even though the first pulley 50 and the second pulley 52 are formed so as to be capable of running idle with respect to the belt 54, instead of this configuration, the first pulley 50 and the second pulley 52 may be formed so as to be capable of running idle with respect to each of the rotation shafts 36*a* and 38*a*.

Second Embodiment

A second embodiment will be described with reference to FIGS. 4 and 5. Because the structures of the openings 20*c* in the housing 20 of the carriage 18 and the target detection units 22*a* in the ink cartridges 22 are the same as the those in the first embodiment, description thereof is omitted A motion converter 60 includes a rotation body 62 and a linear motion member 64. The rotation body 62 is, for example, formed as a gear. A groove 62*a* is formed in the rotation body 62. Moreover, a gear (not illustrated) is fitted onto the rotation shaft 36*a* of the first feeding roller 36. Then, a well-known planetary gear mechanism (not illustrated) is provided between the rotation body 62 and the gear (not illustrated). This planetary gear mechanism is formed so as to be capable of switching between a state of transmitting the rotation of the first feeding roller 36 to the rotation body 62 and a state of not transmitting the rotation of the first feeding roller 36 to the rotation body 62.

Moreover, a boss 64*a* is formed in the linear motion member 64. The boss 64*a* is loosely inserted in the groove 62*a*. Furthermore, the moving part 46*b* of the detector 46 is installed in the linear motion member 64.

In FIG. 4, when the rotation of the first feeding roller 36 is transferred to the rotation body 62 by the planetary gear mechanism, and the rotation body 62 is made to rotate in an anti-clockwise direction, the boss 64*a* that is loosely inserted in the groove 62*a* is pushed toward the device depth direction front surface side along the groove 62*a* and is displaced toward the device depth direction front surface side. Consequently, the linear motion member 64 is made to move toward the device depth direction front surface side. Therefore, the detector 46 that is installed in the linear motion member 64 also moves toward the device depth direction front surface side together with the linear motion member 64.

On the other hand, from the state illustrated in FIG. 5, to move the detector 46 and the linear motion member 64 toward the device rear surface side, in a state where the rotation of the first feeding roller 36 is transferred to the rotation body 62 by the planetary gear mechanism, the rotation body 62 is made to rotate in the clockwise direction. Consequently, the boss 64*a* that is loosely inserted in the groove 62*a* is pushed toward the device depth direction rear surface side along the groove 62*a* and is displaced toward the device depth direction rear surface side. As a result, the linear motion member 64 is made to move toward the device depth direction rear surface side. Consequently, the detector 46 that is installed in the linear motion member 64 also moves toward the device depth direction rear surface side together with the linear motion member 64.

Therefore, by causing the rotation body 62 to rotate in the clockwise direction or anti-clockwise direction in FIGS. 4 and 5, the linear motion member 64 consequently is capable of making the detector 46 move in the device depth direction. In addition, by, for example, providing an encoder sensor that detects the amount of rotation of the rotation body 62 it is possible to perform position control of the detector 46 in the device depth direction on the basis of a detection signal of the encoder sensor.

Consequently, the detector 46 can be made to sequentially move below the plurality of the ink cartridges 22 installed in the housing 20 by the motion converter 60. As a result, it is possible to perform detection of the residual amount of ink in each of the ink cartridges 22 by using the detector 46. Therefore, in the case where the plurality of the ink cartridges 22 are arranged side by side in the device depth direction, because detection of the residual amount is performed by a single detector 46, it is possible to suppress an increase in the cost of the printer 10.

Third Embodiment

A third embodiment will be described with reference to FIG. 6. Because the structures of the openings 20*c* in the housing 20 of the carriage 18 and the target detection units 22*a* in the ink cartridges 22 are the same as the those in the first embodiment, description thereof is omitted. Moreover, the motion converter 48 in this embodiment has the same structure as in the first embodiment.

As illustrated in FIG. 6, a wiping unit 66 is installed on the belt 54 of the motion converter 48. A wiper 66*a* that extends in the device width direction is installed in the wiping unit 66. The wiper 66*a*, for example, is formed of a rubber-like elastomer and is formed so as to have elasticity. The wiper 66*a*, in a state of being in contact with the nozzle surface of the recording head 24, reciprocates in the device depth direction that intersects the device width direction, which is the movement direction of the carriage 18, by the motion converter 48. Consequently, it is possible to wipe off dirt on the nozzle surface of the recording head 24, ink that has attached to the nozzle surface, or the like. In addition, by causing the wiping unit 66 to move toward the device depth direction front surface side or rear surface side, the wiper 66*a* can be moved away from the region facing the recording head 24.

The moving part 46*b* of the detector 46 is installed in the wiping unit 66. The detector 46 moves in the device depth direction with the movement of the wiping unit 66 in the device depth direction. In this embodiment, the sensor body 46*a* of the detector 46 is located below the carriage 18, and is arranged at a position at which it is capable of detecting the target detection units 22*a* of the ink cartridges 22 in the device width direction. Therefore, by causing the wiping unit 66 together with the detector 46 to move in the device depth direction by using the motion converter 48, the detector 46 is capable of sequentially detecting the target detection units 22*a* of the plurality of the ink cartridges 22 and can check the residual amount of ink in each of the ink cartridges 22.

Moreover, an ink prevention wall 66*b* that projects in the device height direction is provided between the wiper 66*a* and the detector 46 in the wiping unit 66. The ink prevention wall 66*b*, when wiping is performed by the wiper 66*a*, blocks ink that has scattered from the nozzle surface of the recording head 24 or from the wiper 66*a* toward the detector 46 side and suppresses the attachment of ink to the sensor body 46*a*.

Fourth Embodiment

A fourth embodiment will be described with reference to FIG. 7 to FIG. 9. As illustrated in FIG. 7, in the carriage 18, a cam surface 20*d*, for example, is provided on the right-side end portion of the housing 20. The cam surface 20*d* is formed as an inclined surface that extends from the device depth direction front surface side to the rear surface side and from the device width direction right side to the left side.

A motion converter 68 includes a cam follower unit 70, an urger 72, and a guide member 74. The cam follower unit 70 includes an engagement surface 70*a* that is capable of engaging with the cam surface 20*d* of the carriage 18. The moving part 46*b* of the detector 46 is installed in the cam follower unit 70. In this embodiment, the sensor body 46*a* of the detector 46 is installed in the cam follower unit 70 in such a manner that the detection position of the sensor body 46*a* becomes the position at the length L in the device width direction with respect to the engagement surface 70*a*.

The guide member 74 extends in the device depth direction. The cam follower unit 70 is formed so as to be guided by the guide member 74 and be capable of being displaced in the device depth direction. Moreover, one end of the urger 72 is installed in the cam follower unit 70 and the other end is installed in the device main body 12. The urger 72 urges the cam follower unit 70 toward the device depth direction front surface side.

Moreover, in this embodiment, the target detection units 22*a* of the plurality of the ink cartridges 22 installed in the carriage 18 are individually arranged so as to be located on a straight line S1 that is separated from the cam surface 20*d* toward the inside of the carriage 18 by the length L.

As illustrated in FIG. 8, when the carriage 18 moves toward the device width direction right-side end portion, the cam surface 20*d* of the carriage 18 and the engagement surface 70*a* of the cam follower unit 70 come into contact with each other. In this state, a portion of the cam surface 20*d* on the device depth direction front surface side and the engagement surface 70*a* come into contact with each other. In the device depth direction, the detector 46 is located at a position at which it is capable of detecting the target detection unit 22*a* of the ink cartridge 22 installed closest to the front surface side of the carriage 18 in the device depth direction.

Referring to FIG. 9, the carriage 18 is moved in the device width rightward direction from the state illustrated in FIG. 8, and the cam follower unit 70 is pushed by the cam surface 20*d*. The cam follower unit 70 resists the urging force of the urger 72 and moves toward the device depth direction rear surface side. Because the target detection units 22*a* are provided at positions at the length L from the cam surface 20*d*, when the cam follower unit 70 is located at a position corresponding to each of the ink cartridges 22 in the device depth direction, the detector 46 is capable of detecting each of the target detection units 22*a* of the ink cartridges 22 and checking the residual amount of ink in each of the ink cartridges 22.

Moreover, from the state illustrated in FIG. 9, the carriage 18 is made to move in the device width leftward direction and the cam follower unit 70 is displaced toward the device depth direction front surface side by the urging force of the urger 72. Therefore, by controlling the movement of the carriage 18 in the device width direction, the cam follower unit 70 consequently is capable of controlling the position of the detector 46 in the device depth direction.

Fifth Embodiment

A fifth embodiment will be described with reference to FIG. 10 to FIG. 13. As illustrated in FIG. 10, a motion converter 76 includes an arm 78. The arm 78 is installed in the device main body 12 and is formed so as to be capable of swinging about a fulcrum 80. An urger (not illustrated), for example, a torsion spring or the like, is provided on the arm 78 and urges the arm 78 in a clockwise direction in FIG. 10. In a state in which an external force is not being applied to the arm 78, as illustrated in FIG. 10, the tip of the arm 78 comes into contact with a swing-limiting unit 82 that is provided in the device main body 12 and the swinging of the arm 78 in the clockwise direction is stopped.

The moving part 46*b* of the detector 46 is installed on the tip of the arm 78. Therefore, the detector 46 swings about the fulcrum 80 together with the swinging of the arm 78. Moreover, an engagement unit 78*a* that engages with at least one portion of the carriage 18 is provided on the tip of the arm 78.

Moreover, in the plurality of the ink cartridges 22 that are arranged in a line in the device depth direction in the carriage 18, the target detection units 22*a* are formed in a state in which the angle thereof changes with respect to the device depth direction in an anti-clockwise direction in FIG. 10 sequentially from the device depth direction front surface side toward the rear surface side. Specifically, the angles of the target detection units 22*a* in the ink cartridges 22 with respect to the device depth direction are set to be within a region in which the target detection units 22*a* of the ink cartridges 22 corresponding to the detector 46 are detectable when the arm 78 swings and is located below the ink cartridges 22. Similarly, the openings 20*c* provided in the lower surface of the housing 20 of the carriage 18 are also formed in a state in which the angle thereof changes in accordance with the target detection units 22*a*.

As illustrated in FIG. 11, the carriage 18 moves in the device width rightward direction and, in a state in which the engagement unit 78*a* comes into contact with a right side surface 20*e* of the housing 20 of the carriage 18 in the device width direction, the detector 46 provided on the tip of the arm 78 is located below the ink cartridges 22 provided on the device depth direction front surface side of the carriage 18 and becomes capable of detecting the target detection units 22*a* of the ink cartridges 22.

From the state illustrated in FIG. 11, when the carriage 18 is made to move in the device width rightward direction, the right side surface 20*e* of the carriage 18 pushes the engagement unit 78*a* in the device width rightward direction. Consequently, the arm 78, resists an urging force of an urger (not illustrated), and swings in an anti-clockwise direction in FIG. 12. In FIG. 12, the arm 78 is pushed by the carriage 18 and swings up to a position corresponding to the third ink cartridge 22 from the device depth direction front surface side. In this state, because the target detection unit 22*a* of the third ink cartridge 22 is located above the detector 46 of the arm 78 that has swung in an anti-clockwise direction in FIG. 12, it becomes possible to detect the target detection unit 22*a* by using the detector 46.

Next, when the carriage 18 is further moved in the device width rightward direction, the arm 78 is further swung in an anti-clockwise direction in FIG. 13. The arm 78 enters a state in which it extends in the device width direction. In this state, the detector 46 that is provided on the tip of the arm 78 is located below the target detection unit 22*a* of the ink cartridge 22 that is arranged closest to the most rear surface side of the carriage 18 in the device depth direction. Therefore, even in this state, the detector 46 is capable of detecting the target detection unit 22*a*.

Moreover, by making the carriage 18 move in the device width leftward direction it is possible to swing the arm 78 in a clockwise direction in FIG. 13 and return the arm 78 back to a position at which the arm 78 comes into contact with the swing limiting unit 82 by the urging force of the urger (not illustrated).

In this embodiment, when the arm 78 is swung, because it passes below the target detection units 22*a* of the ink cartridges 22 of the carriage 18, it becomes possible to detect the target detection units 22*a* of the ink cartridges 22 by using the detector 46 and it is possible to check the residual amount of ink in each of the ink cartridges 22.

Moreover, also in this embodiment, the position of the detector 46 in the device depth direction can be controlled by varying the swing amount of the arm 78 by controlling the movement of the carriage 18 in the device width direction.

Modification Examples of Embodiments (1) In each of the embodiments, the ink cartridges 22 are formed as six pieces installed in the housing 20 of the carriage 18; however, the ink cartridges 22 are not limited to six pieces and the number of the ink cartridges 22 installed in the housing 20 may be 1 to 5 pieces or 7 or more pieces.

(2) In each of the embodiments, an optical sensor is used as the detector 46 for detecting the target detection units 22*a* that are provided in the ink cartridges 22; however, instead of this, the detector 46 may be a magnetic sensor, an ultrasonic sensor or the like for detecting the target detection units 22*a*.

In summarizing the above descriptions, the printer 10 includes the carriage 18 that is capable of moving in the device width direction which is a certain direction and that has the recording head 24 that performs recording on a medium and a plurality of the ink cartridges 22 that house ink that is discharged from the recording head 24, the plurality of the ink cartridges 22 being arranged in a line in the device depth direction which is a direction that intersects the device width direction which is the movement direction of the carriage 18, the ink cartridges 22 including the target detection units 22*a* that are detected by the detector 46 that detects the residual amount of ink, the detector 46 including the moving part 46*b* that moves in the device depth direction which is a direction that intersects the movement direction of the carriage 18 and the detector 46 detecting the target detection units 22*a* of the plurality of the ink cartridges 22 by movement of the moving part 46*b*.

According to the above configuration, in the carriage 18, the plurality of the ink cartridges 22 are provided in a line in the device depth direction that is a direction that intersects the device width direction that is the movement direction of the carriage 18. The detector 46 that detects the residual amount of ink includes the moving part 46*b*, which moves along a direction that intersects the movement direction of the carriage 18, that is, the direction in which the plurality of the ink cartridges 22 are arranged, and detects the target detection units 22*a* of the plurality of the ink cartridges 22 by the movement of the moving part 46*b*. Therefore, even in a structure in which the ink cartridges 22 are not arranged in a direction along the movement direction of the carriage 18, it is possible to detect the residual amount of ink of each of the ink cartridges 22 while suppressing an increase in cost.

The feeding rollers 34 that feed a medium in the device depth direction, which is a direction that intersects the movement direction of the carriage 18, and the motion converters 48 and 60 that move the moving part 46*b* by converting the rotation of the feeding rollers 34 into linear movement in the device depth direction that is a direction that intersects the movement direction of the carriage 18 are included. According to this configuration, it is not necessary to provide a drive source for the sole purpose of driving the moving part 46*b* and it is therefore possible to suppress an increase in the cost of the device.

The feeding rollers 34 include the first feeding roller 36 that is provided upstream of the recording head 24 in the medium transport direction and the second feeding roller 38 that is provided downstream of the recording head 24 in the medium transport direction. The motion converter 48 includes the first pulley 50 that is provided on the rotation shaft 36*a* of the first feeding roller 36 and the second pulley 52 that is provided on the rotation shaft 38*a* of the second feeding roller 38 and the belt 54 that is looped around the first pulley 50 and the second pulley 52 and that engages with the moving part 46*b*. According to this configuration, it is possible to simplify the structure of the motion converter 48 and reduce the cost thereof.

The motion converter 60 includes the rotation body 62 which receives rotational motive power from the feeding rollers 34 and the linear motion member 64 that includes the boss 64*a* that is loosely inserted in the groove 62*a* formed in the rotation body 62, the linear motion member 64 moving in the device depth direction as a result of the boss being pushed in the device depth direction which intersects the device width direction which is the movement direction of the carriage 18 by the rotation of the rotation body 62, and the linear motion member 64 engaging with the moving part 46*b*. According to this configuration, it is possible to simplify the structure of the motion converter 60 and reduce the cost thereof.

The printer 10 has the wiping unit 66 that includes the wiper 66*a* that wipes the recording head 24 while moving in the device depth direction which is a direction that intersects the device width direction which is the movement direction of the carriage 18, and the moving part 46*b* is provided in the wiping unit 66. According to this configuration, it is not necessary to provide a drive source for the sole purpose of driving the moving part 46*b* and it is therefore possible to suppress an increase in the cost of the device.

The cam surface 20*d*, which is formed so as to be inclined with respect to the device width direction which is the movement direction of the carriage 18, is provided on the carriage 18, the moving part 46*b* is capable of engaging with the cam surface 20*d* and is provided on the cam follower unit 70 that is capable of moving in the device depth direction which is a direction that intersects the device width direction which is the movement direction of the carriage 18, and the cam follower unit 70 moves in the device depth direction which is a direction that intersects the movement direction of the carriage 18 as a result of the cam follower unit 70 being pushed by the cam surface 20*d* that moves with the movement of the carriage 18. According to this configuration, it is not necessary to provide a drive source for the sole purpose of driving the moving part 46*b* and it is therefore possible to suppress an increase in the cost of the device.

The moving part 46*b* is provided on the arm 78 that is capable of swinging about the fulcrum 80 and moves as the arm 78 swings. According to this configuration, it is possible to simplify the structure that moves the moving part 46*b* and reduce the cost thereof.

Moreover, in this embodiment, even though the detector 46 and the motion converters 48, 60, 68, and 76 according to the invention are applied in an ink jet printer as an example of a recording device, it is possible to generally apply these to other liquid ejecting apparatuses.

Here, a liquid ejecting apparatus uses an ink jet type recording head, is not limited to a recording device such as a printer that performs recording on a recording medium by discharging ink from a recording head, a photocopier or a facsimile machine, and may be a device that attaches a liquid to a target ejecting medium by ejecting, instead of ink, a liquid corresponding to the purpose to the target ejecting medium corresponding to the target recording medium from a liquid ejecting head corresponding to the ink jet type recording head.

Examples of a liquid ejecting head other than the recording head include a color material ejecting head used for the manufacture of color filters such as those of liquid crystal displays, an ejecting head used for ejecting electrode materials (conductive paste) used for the formation of electrodes such as those of an organic electroluminescence (EL) display or a field effect display (FED), a bioorganic substance ejecting head used in the manufacture of biochips, and a sample ejecting head as a precision pipette.

In addition, the invention is not limited to the above described embodiments, and it goes without saying that it is possible to make various modifications within the scope of the invention described in the claims and that these are included in the scope of the invention.

The entire disclosure of Japanese Patent Application No. 2016-092313, filed May 2, 2016 is expressly incorporated by reference herein.

What is claimed is:

1. A recording device comprising:

a carriage that has a recording head that performs recording on a medium and a plurality of liquid cartridges that house a liquid to be ejected from the recording head, the plurality of liquid cartridges being arranged in a line in a direction that intersects a movement direction of the carriage and being provided with a target detection unit, and a detector that includes a moving part which moves the detector in a direction that intersects the movement direction of the carriage and also reciprocates in a direction that the medium is transported in a printing area where the recording head ejects the liquid and that, by the movement of the moving part, detects the residual amount of the liquid between the detector and each of the target detection units of the plurality of the liquid cartridges, when the carriage has stopped, wherein the moving part is located in a home position that is an end portion of the recording device in the movement direction of the carriage, the moving part being separate from any moving part that moves the carriage.

2. The recording device according to claim 1 further comprising:

a feeding roller that feeds the medium in a direction that intersects the movement direction of the carriage and a motion converter that moves the moving part by converting rotation of the feeding roller into linear movement in a direction that intersects the movement direction of the carriage.

3. The recording device according to claim 2, wherein the feeding roller includes a first feeding roller that is provided upstream of the recording head in a medium transport direction and a second feeding roller that is provided downstream of the recording head in the medium transport direction, and the motion converter includes a first pulley that is provided on a rotation shaft of the first feeding roller, a second pulley that is provided on a rotation shaft of the second feeding roller, and a belt that loops around the first pulley and the second pulley and that engages with the moving part.

4. The recording device according to claim 2, wherein the motion converter includes a rotation body that receives rotational motive power from the feeding roller and a linear motion member that includes a boss that is loosely inserted in a groove formed in the rotation body, the linear motion member moving in a direction which intersects the movement direction of the carriage as a result of the boss being pushed in the direction which intersects the movement direction of the carriage by the rotation of the rotation body, and the linear motion member engaging with the moving part.

5. The recording device according to claim 1 further comprising:

a wiping unit that includes a wiper that wipes the recording head while moving in a direction that intersects the movement direction of the carriage, wherein the moving part is provided in the wiping unit.

6. The recording device according to claim 1, wherein a cam surface, which is formed so as to be a surface inclined with respect to the movement direction of the carriage, may be provided on the carriage, the moving part is capable of engaging with the cam surface and is provided in a cam follower that is capable of moving in a direction that intersects the movement direction of the carriage, and the cam follower unit moves in a direction that intersects the movement direction of the carriage as a result of the cam follower unit being pushed by the cam surface that moves with the movement of the carriage.

7. The recording device according to claim 1, wherein the moving part is provided so as to be capable of swinging about a fulcrum and the moving part moves by the swinging of the arm.

8. The recording device according to claim 1, wherein the detector that, by the movement of the moving part, detects the residual amount of the liquid between the detector and each of the target detection units of the plurality of the liquid cartridges, when the carriage is located in a home position that is an end portion of the recording device in the movement direction of the carriage.

* * * * *